US008783675B2

(12) United States Patent
Buck et al.

(10) Patent No.: US 8,783,675 B2
(45) Date of Patent: Jul. 22, 2014

(54) APPARATUS HAVING PAIRED LIFTING MEMBERS FOR SEPARATING STACKED PALLETS

(76) Inventors: James R. Buck, Jacksonville, FL (US); Larry White, Atlanta, GA (US)

( * ) Notice: Subject to any disclaimer, the term of this patent is extended or adjusted under 35 U.S.C. 154(b) by 932 days.

(21) Appl. No.: 12/924,578

(22) Filed: Sep. 30, 2010
(Under 37 CFR 1.47)

(65) Prior Publication Data

US 2011/0203621 A1 Aug. 25, 2011

Related U.S. Application Data

(60) Provisional application No. 61/277,847, filed on Sep. 30, 2009.

(51) Int. Cl.

| | |
|---|---|
| ***B23Q 1/00*** | (2006.01) |
| ***B65G 57/00*** | (2006.01) |
| ***B65H 29/00*** | (2006.01) |
| ***B65D 19/38*** | (2006.01) |

(52) U.S. Cl.
CPC ..... *B65D 19/38* (2013.01); *B65D 2519/00955* (2013.01)
USPC ..... 269/309; 211/59.4; 414/788.1; 108/106

(58) Field of Classification Search
CPC ..... B65G 1/14; B65G 2201/0217; B65G 49/085; B23Q 1/0063; B23Q 3/108
USPC ..... 269/9, 309, 310; 254/89 R; 211/59.4, 211/59.1, 49.1, 207; 414/788.1, 795.4; 108/106
See application file for complete search history.

(56) References Cited

U.S. PATENT DOCUMENTS

| | | | | |
|---|---|---|---|---|
| 1,019,384 | A | | 3/1912 | Walz |
| 1,275,983 | A | | 8/1918 | Rusmussen |
| 1,589,157 | A | | 6/1926 | Hatch, Jr. |
| 1,708,588 | A | | 4/1929 | Proctor |
| 2,595,599 | A | | 5/1952 | Naillon |
| 2,647,646 | A | | 8/1953 | Naillon |
| 2,657,810 | A | | 11/1953 | Garrick |
| 3,103,422 | A | | 9/1963 | Green |
| 3,940,174 | A | | 2/1976 | Mayes |
| 4,523,526 | A | * | 6/1985 | O'Neill ..... 108/149 |
| 4,572,382 | A | | 2/1986 | Niederprum |
| 4,712,691 | A | | 12/1987 | Grill et al. |
| 5,005,712 | A | | 4/1991 | Niederprum |
| 5,096,216 | A | | 3/1992 | McCalla |
| 5,411,234 | A | | 5/1995 | Schoeller |
| 5,938,051 | A | | 8/1999 | Scholler et al. |
| 6,223,911 | B1 | | 5/2001 | Weaver |
| 6,405,883 | B1 | | 6/2002 | Schambach |
| 7,210,892 | B2 | | 5/2007 | Strobel |
| 7,500,573 | B1 | | 3/2009 | Flynn |

* cited by examiner

*Primary Examiner* — Lee D Wilson
*Assistant Examiner* — Jamal Daniel
(74) *Attorney, Agent, or Firm* — Thomas C. Saitta

(57) ABSTRACT

An apparatus for vertically separating stacked pallets a sufficient distance such that each pallet in the stack can be cleaned, with the pallets then immediately restacked after cleaning.

4 Claims, 2 Drawing Sheets

APPARATUS HAVING PAIRED LIFTING MEMBERS FOR SEPARATING STACKED PALLETS

This application claims the benefit of U.S. Provisional Patent Application Ser. No. 61/277,847, filed Sep. 30, 2009, the disclosure of which is further incorporated herein by reference.

BACKGROUND OF THE INVENTION

This invention relates generally to the field of separating stacked pallets for cleaning or other purposes, and more particularly to the field of separating stacked pallets by vertically expanding the stack, performing the cleaning operation, and re-stacking the pallets.

Vast numbers of pallets are in use in multiple industries. In many instances, the pallets become contaminated or dirty and must be cleaned prior to reuse. The dirty pallets are usually transported and stored in vertical stacks. One common technique for cleaning pallets is to handle each pallet individually by removing them one at a time from the pallet stack, washing or spraying each pallet as it is presented, then restacking the pallets. This is a very time consuming process, since each pallet must be removed from the pallet stack of dirty pallets and a new stack must be created of clean pallets.

There is a need for an apparatus and technique to separate stacks of pallets in a batch process for simultaneous cleaning of the entire stack rather than removing and cleaning each pallet individually. However, because major portions of the pallets' upper and lower surfaces are in direct contact with other pallets when stacked, or because the pallets are shaped so as to nest when stacked, it is not possible to adequately clean the pallet stack in a batch mode using typical washing and spraying techniques. This invention meets the stated need and addresses the problems inherent in the stacked pallets by providing an apparatus that vertically expands the pallet stack, quickly and easily separating each of the pallets in the stack a small but sufficient vertical distance from the other pallets such that the tops, bottoms and sides of the pallets are exposed and can be cleaned quickly and efficiently using spraying equipment. Upon cleaning, the expanded stack of pallets is then immediately contracted into a compact stack for transport.

SUMMARY OF THE INVENTION

The invention is an apparatus for expanding stacked pallets such that each individual pallet is separated a short distance vertically. The apparatus comprises pallet separation means for vertically separating each pallet in the stack, the pallets being temporarily spaced sufficient distance such that no portion of any pallet is in contact with an adjacent pallet and such that any contaminants, dirt or other undesirable substances are adequately exposed for removal by cleaning means for removing the contaminants, such as washing or spraying equipment that directs high pressure jets of fluid onto and between the pallets.

The apparatus comprises a plurality of horizontally-extending pallet lifting members that are linked in vertical orientation. The lifting members comprise horizontally-oriented insertion arm members that fit between adjacent pallets or into apertures in individual pallets, and carriage members, the insertion arm members being insertable into the pallet stack by lateral translation movement. The lifting members are linked by spacing link members that allow successive separation of each lifting member from the adjacent lifting member as the uppermost lifting members are raised. For each pallet there are two opposing lifting members, such that a first lifting member is disposed on one side of the pallet and a second lifting member is disposed on the opposing side of the pallet, the insertion arm members facing inwardly. Each pallet thus has a pair of lifting members. The lifting members are vertically disposed in two opposing and separate arrays, each of the lifting members positioned to correspond to an individual pallet in the pallet stack and linked in vertical manner. Means for raising and lowering each array of lifting members, such as a motorized chain or belt, hydraulic members, or the like, are provided to expand and contract the pallet stack.

Initially, the opposing arrays of lifting members are laterally spaced such that the pallet stack may be placed between the two arrays using a forklift, conveyor or similar means. In the neutral or loading orientation, with the pallet stack having been put into position, the opposing arrays of lifting members are laterally translated against opposite sides of the pallet stack, i.e., brought toward each other, such that the insertion arm members become situated between or mated with the corresponding individual pallets. The uppermost opposed lifting members are then raised, thereby lifting the uppermost pallet from the stack. The spacing link members allow the top pallet to be raised a short distance prior to vertical movement of the second layer of lifting members, thereby separating the pallet from the one below. As the uppermost lifting members and the top pallet continue to rise, the second pair of lifting members and their associated pallet begin to rise. This process is successively repeated until all of the pallets are raised and separated from the adjoining pallets. The cleaning process may then be initiated and all pallets are cleaned simultaneously. Upon completion, the arrays of lifting members are lowered, thereby restacking the now clean pallets for removal from the apparatus.

The invention is a pallet separating apparatus adapted to expand a stack of pallets in the vertical direction such that each pallet is separated a short distance from adjoining pallets and then restack the pallets, the apparatus comprising:

a plurality of lifting members, each lifting member comprising a pair of carriage members, an extended bar member, a mounting flange and at least two horizontally-oriented insertion arm members, and at least one post member positioned on the side of the carriage member;

a plurality of spacing link members each comprising an elongated extension slot, said spacing link members being retained on said post members of adjoining lifting members;

a first array of said lifting members disposed in a first frame assembly and a second array of said lifting members disposed in a second frame assembly;

lateral translation means for reciprocating said first and second frames toward and away from each other;

separating means for raising and lowering each array of lifting members such that vertically adjoining lifting members are separated;

whereby with a stack of pallets positioned between said first and second frame assemblies, said frame assemblies are laterally moved together such that said insertion arm members of said lifting members are inserted into or between individual pallets in said stack, the uppermost set of opposing lifting members are raised, thereby raising the uppermost pallet from the stack and separating the uppermost sets of opposing lifting members from the next adjacent set of opposing lifting members, continuing to raise said uppermost set of lifting members until said extension slots of said link members abut the post members of the next lower adjacent set of opposing lifting members, such that the next adjacent set of opposing lifting members and the next adjoining pallet are raised, and continuing this operation until all said pallets in said stack are separated from adjoining pallets, performing a cleaning operation on the separated pallets, lowering the lifting members and pallets to reform the stack, and separating said first and second frame assemblies.

DETAILED DESCRIPTION OF THE INVENTION

With reference to the drawings, the invention will now be described in detail with regard for the best mode and the preferred embodiment. The invention is an apparatus and the method of using the apparatus for vertically expanding a stack of pallets. The apparatus comprises pallet separation means for vertically separating each pallet in the stack, the pallets being temporarily spaced sufficient distance such that no portion of any pallet is in contact with an adjacent pallet and such that any contaminants, dirt or other undesirable substances are adequately exposed for removal by cleaning means for removing the contaminants, such as washing or spraying equipment that direct high pressure jets of fluid onto and between the pallets.

Figure 1:
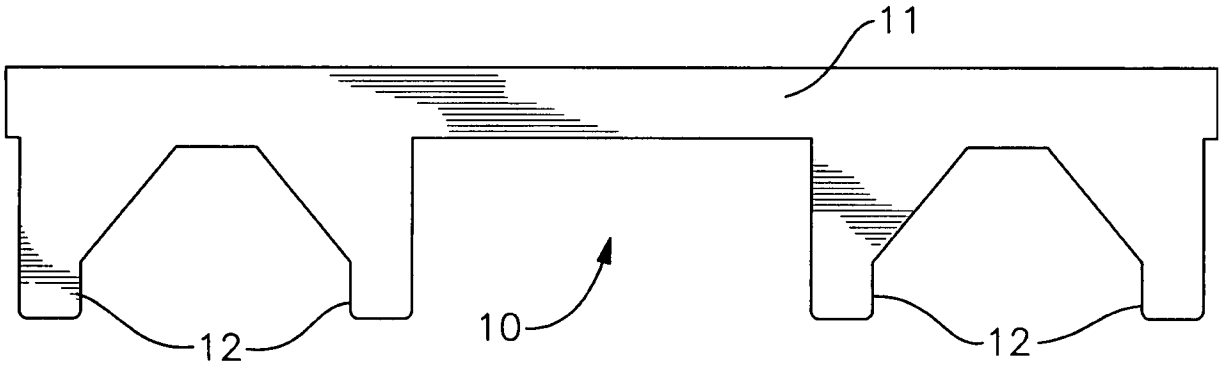
FIG. 1 is a top view of an embodiment of the insertion arm members.
Figure 2:
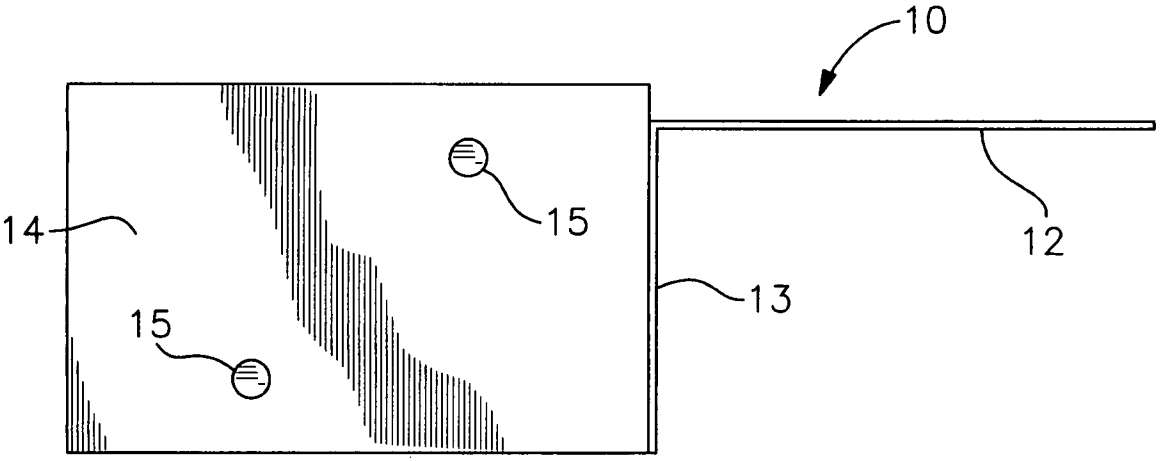
FIG. 2 is an end view of the lifting member embodiment.

The apparatus comprises a plurality of horizontally extending pallet lifting members 10 that are linked in vertical orientation in a chain-like manner. As shown in FIGS. 1 and 2, the lifting members 10 each comprise a pair of carriage members 14, an extended bar member 11, a mounting flange 13 and at least two horizontally-oriented insertion arm members 12, the arm members 12 fitting between adjacent pallets 99 or into apertures in individual pallets 99, the insertion arm members 12 being insertable into the pallet stack by lateral or horizontal movement. Each lifting member 10 is provided with at least one post member 15 positioned on the side of the carriage member 14. The number and shape of the insertion arm members 12 may vary depending on the design and structure of pallets 99.

Figure 3:
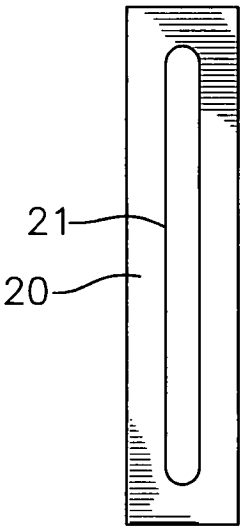
FIG. 3 is a side view of a spacing link member.

The lifting members 10 are linked to each other by spacing link members 20, as shown in FIG. 3, that allow successive separation of each lifting member 10 from the adjacent lifting member 10 as the uppermost lifting members 10 are raised. Each spacing link member 20 comprises an elongated body and an elongated extension slot. The linking members 20 are retained by the post members 15 of adjoining carriage members 14. Multiple lifting members 10 and linking members 20 are joined in this manner to form an extended chain.

Figure 4:
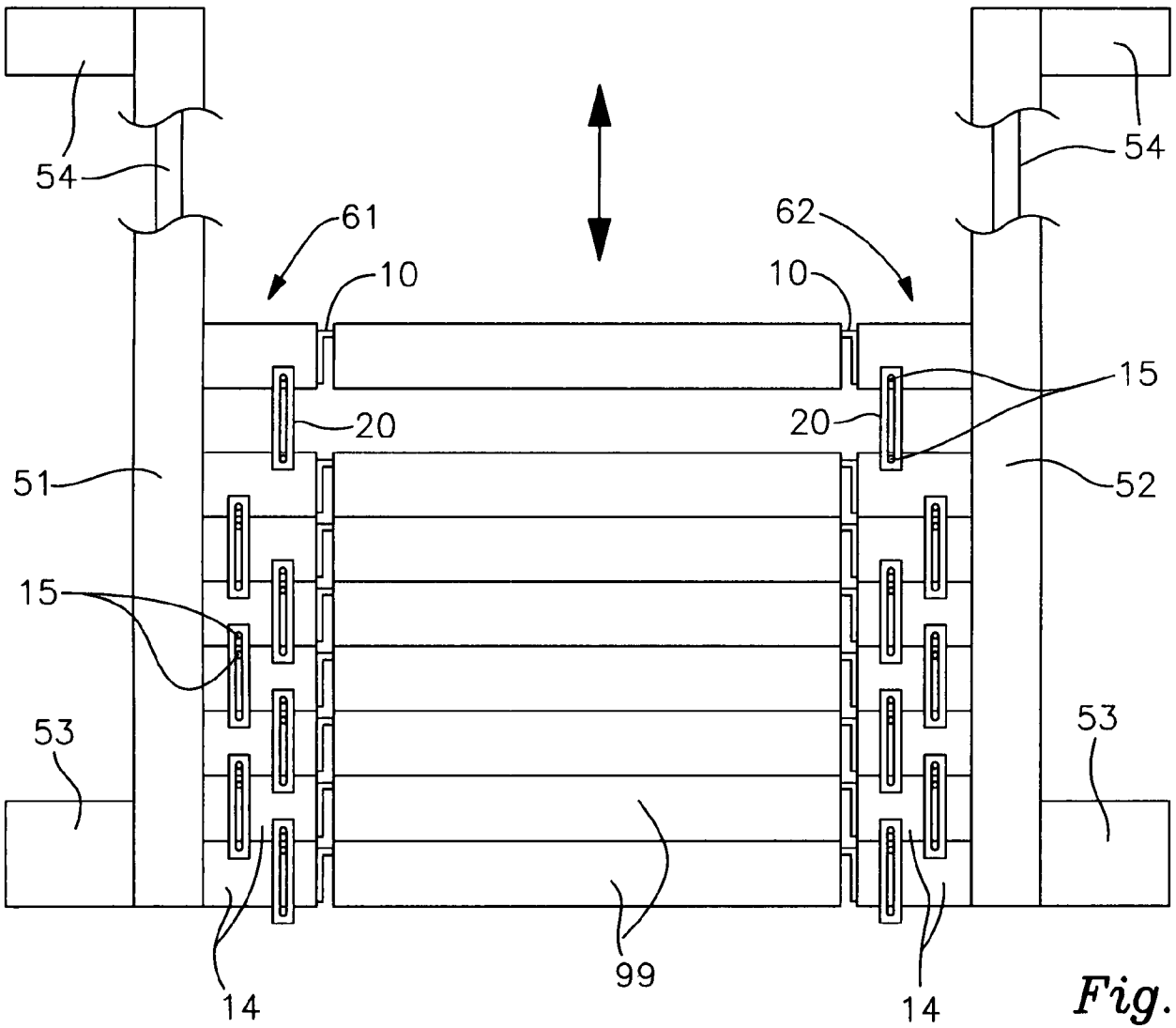
FIG. 4 is a representative illustration of an embodiment of the invention, showing the opposing arrays of lifting members advanced to a pallet stack, with a pallet having been separated by vertical movement of the uppermost pair of lifting members.

The separation functionality is illustrated in FIG. 4. In the neutral or loading orientation, the lifting members 10 are disposed vertically, the lifting members 10 resting one atop the other in a stack with the insertion arm members 12 facing laterally and separated by the required distance for insertion into the pallet stack. As the upper lifting member 10 is raised, the spacing link member 20 is stationary until it abuts the post member 15 of the next lower lifting member 10, thereby defining the separation distance between the adjacent lifting members 10 and raising the lower lifting member 10. This process continues for each lifting member 10 in the lifting member assembly.

For each pallet there are at least four insertion arm members 12 in order to properly balance the pallet 99. One of the lifting members 10 is positioned in opposition to the other lifting member 10, such that a first lifting member 10 is disposed on one side of the pallet 99 and a second lifting member 10 is disposed on the opposing side of the pallet 99, the insertion arm members 12 facing each other. Each pallet 99 thus has a corresponding pair of lifting members 10. The lifting members 10 are vertically disposed in two opposing and separate arrays 61 and 62, each paired set of lifting members 10 vertically positioned to correspond to an individual pallet 99 in the pallet stack. The arrays 61 and 62 are mounted within frame assemblies 51 and 52. The frame members 51 and 52 are structured to define tracks that allow vertical movement of the lifting members 10. Separating means 54 for raising and lowering each array 61 and 62 to separate the lifting members 10, such as a motorized chain or belt, hydraulic members, or the like, are provided on frame members 51 and 52 to expand and contract the pallet stack. Lateral translation means 53 for reciprocating the frames 51 and 52, such as for example motorized assemblies on tracks or rollers, are provided such that the two opposing arrays 61 and 62 can be moved toward and then away from each other.

In the neutral or loading orientation, the arrays of lifting members 10 are laterally translated inwardly against opposing sides of the pallet stack such that the insertion arm members 12 are placed between or mated with the individual pallets 99. The uppermost lifting member 10 of each set is raised, thereby lifting the uppermost pallet 99 from the stack. Preferably, the lifting members 10 of one array 61 are raised into a higher position than the lifting members of the opposing array, so that the pallet 99 will be raised in a tilted orientation to allow water to more easily drain. The spacing link members 20 allow the top pallet 99 to be raised a short distance prior to vertical movement of the next set of lifting members 10. As the uppermost lifting members 10 and the top pallet 99 continue to rise, the associated link members 20 are raised until the bottom of the slots 21 make contact with the post members 15 of the next lower carriage members 14, at which time the second lifting members 10 and their associated pallet 99 begin to rise. This process is successively repeated until all of the pallets 99 are raised and separated from the adjoining pallets. The cleaning process is then initiated and all pallets 99 are cleaned simultaneously. Upon completion, the sets of lifting members 10 are lowered, thereby restacking the now clean pallets 99 for removal from the apparatus after the frame assemblies 51 and 52 have been retracted.

It is understood that equivalents and substitutions for certain elements described above may be obvious to those of ordinary skill in the art, and therefore the true scope and definition of the invention is to be as set forth in the following claims.

We claim:

1. A pallet separating apparatus adapted to expand a stack of pallets in the vertical direction such that each pallet is separated a short distance from adjoining pallets and then restack the pallets, the apparatus comprising:

a plurality of lifting members, each lifting member comprising a pair of carriage members, an extended bar member, a mounting flange and at least two horizontally-oriented insertion arm members, and at least one post member positioned on the side of the carriage member;

a plurality of spacing link members each comprising an elongated extension slot, said spacing link members being retained on said post members of adjoining lifting members;

a first array of said lifting members disposed in a first frame assembly and a second array of said lifting members disposed in a second frame assembly;

lateral translation means for reciprocating said first and second frames toward and away from each other;

separating means for raising and lowering each array of lifting members such that vertically adjoining lifting members are separated;

whereby with a stack of pallets positioned between said first and second frame assemblies, said frame assemblies are laterally moved together such that said insertion arm members of said lifting members are inserted into or between individual pallets in said stack, the uppermost set of opposing lifting members are raised, thereby raising the uppermost pallet from the stack and separating the uppermost sets of opposing lifting members from the next adjacent set of opposing lifting members, continuing to raise said uppermost set of lifting members until said extension slots of said link members abut the post members of the next lower adjacent set of opposing lifting members, such that the next adjacent set of opposing lifting members and the next adjoining pallet are raised, and continuing this operation until all said pallets in said stack are separated from adjoining pallets, performing a cleaning operation on the separated pallets, lowering the lifting members and pallets to reform the stack, and separating said first and second frame assemblies.

2. The apparatus of claim 1, wherein said first array is raised to a higher position than said second array.

3. The apparatus of claim 1, wherein said separating means comprise a hydraulic system.

4. The apparatus of claim 1, further comprising cleaning equipment adapted to spray liquid onto said pallets.

* * * * *